United States Patent [19]

Deaner

[11] 4,407,342

[45] Oct. 4, 1983

[54] TOOL FOR WOOD DOWEL STRIATION

[75] Inventor: Frederick R. Deaner, Hamilton, N.Y.

[73] Assignee: Eaton Industries, Inc., Eaton, N.Y.

[21] Appl. No.: 267,735

[22] Filed: May 28, 1981

[51] Int. Cl.[3] ..... B27M 3/28

[52] U.S. Cl. ..... 144/2 R; 72/275; 144/12; 409/259

[58] Field of Search ..... 409/259, 268, 275; 144/12, 120, 353, 2 R; 72/274, 275

[56] References Cited

U.S. PATENT DOCUMENTS

| | | | |
|---|---|---|---|
| 435,463 | 9/1890 | Stewart | 144/12 |
| 1,668,004 | 5/1928 | Caron | 144/12 |
| 2,612,193 | 9/1952 | Springer | 144/12 |
| 2,865,413 | 12/1958 | Smith | 144/12 X |

*Primary Examiner*—Z. R. Bilinsky

[57] ABSTRACT

A tool for forming striations (shallow grooves) in a cylindrical dowel which includes a block having a dowel hole, and crested edges, such as screw threads, extending into the hole such that when a dowel is driven through the hole, it will be provided with surface grooves on one or both sides to provide glue release passages and a tight dowel joint.

2 Claims, 4 Drawing Figures

TOOL FOR WOOD DOWEL STRIATION

FIELD OF THE INVENTION

Tools for forming striations on dowels to improve gluing characteristics.

BACKGROUND OF INVENTION

It is known to provide lineal indentations on wood dowels, especially spiral surface grooves, to improve the gripping characteristics when glued. Dowels of this nature are usually furnished in certain specified lengths and because of this are relatively expensive.

It is an object of the present invention to enable a wood worker to purchase the less expensive dowel rod in the usual lengths of 30" or 36" with a smooth surface. With the tool to be described, the plain dowel rod can be cut to the desired lengths and then scribed with lineal striations by driving the dowel through the tool once or twice.

The striations are actually pressed into the surface of the dowel and will function to allow glue to escape through the shallow grooves in a blind hole. But contact with a wet glue will cause the pressed-in wood to swell and expand out again essentially to the true cylindrical shape. This provides a very tight joint.

Other objects of the invention will be apparent in the following specification and claims directed to persons skilled in the art and setting forth the invention and the manner and process of using it.

BRIEF DESCRIPTION OF THE DRAWINGS

DRAWINGS accompany the disclosure and the various views thereof may be briefly described as.

DETAILED DESCRIPTION OF THE INVENTION

The invention is a tool for forming pressed-in grooves, creases, or striations in the cylindrical wall of smooth dowel rod by providing a drive block with transverse holes slightly larger than dowel diameters. In the walls of these holes are placed a multiple of blunt edges which project into the holes a short distance. When a dowel is driven through the hole, the edges will press in to the surface of the dowel and form shallow grooves or striations.

DISCLOSURE TO ENABLE PERSONS SKILLED IN THE ART TO PRACTICE THE INVENTION

Figure 1:
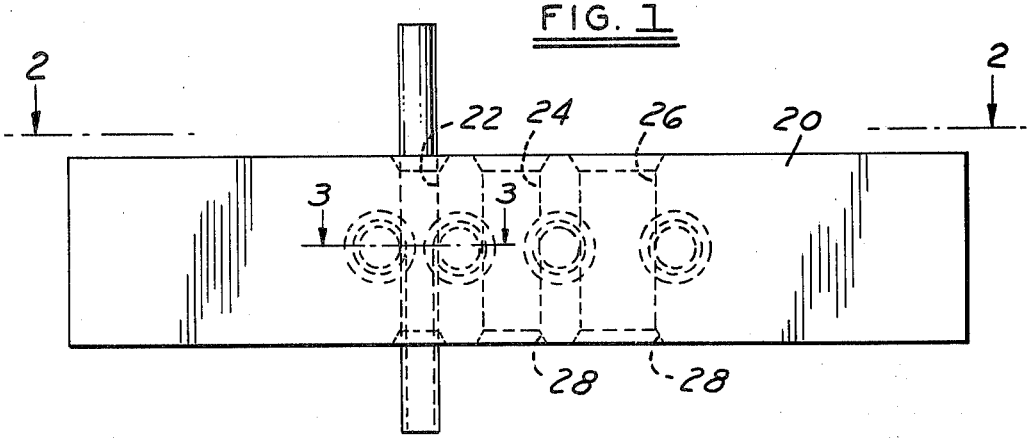
FIG. 1, a side view of the tool.
Figure 2:
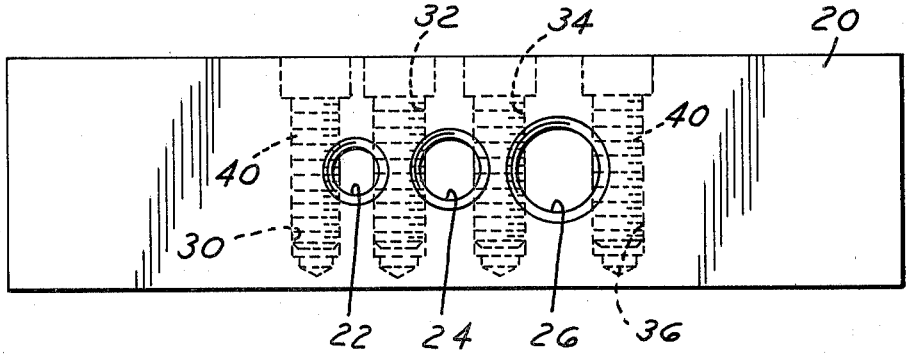
FIG. 2, a top view of the tool at line 2—2 of FIG. 1.

In FIGS. 1 and 2, a block of material 20 has an elongate shape with a rectangular cross-section. The block is formed preferably of a native hardwood such as maple although other materials may be used such as steel or aluminum. The block 20 has three transverse parallel holes 22, 24, 26 for receiving, for example, dowels with dimensions respectively of $\frac{1}{4}$", $\frac{3}{8}$", and $\frac{1}{2}$". The holes are preferably formed slightly oversize of the dowels to be received. For example, the holes can be 1/64" larger than the dowel. The holes are also preferably provided with a chamfer 28 at each end to facilitate the pass through of the dowel.

Figure 3:
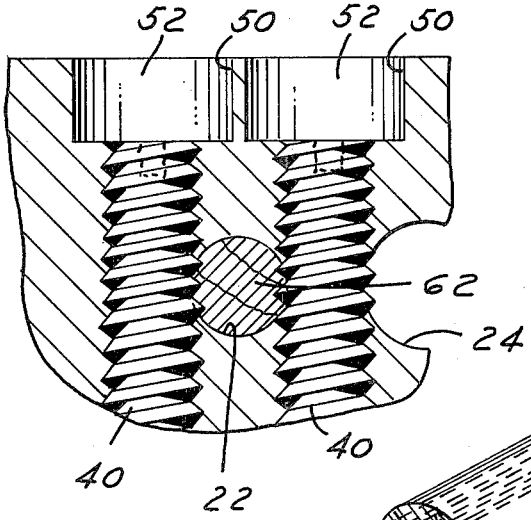
FIG. 3, a partial section taken at line 3—3 of FIG. 1.
Figure 4:
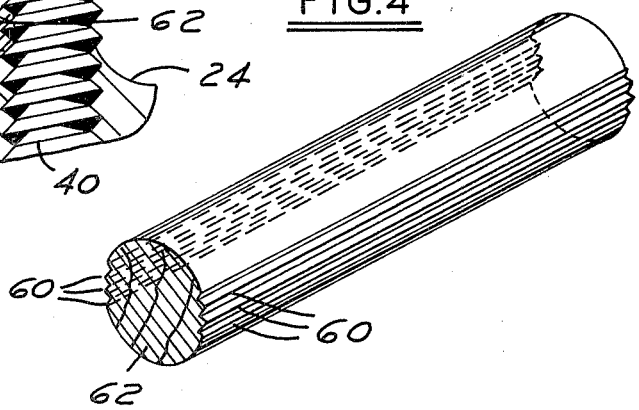
FIG. 4, a view of a length of the dowel rod which has been passed through the tool.

Four holes 30, 32, 34, 36 are now drilled into the block 20 on axes at 90° to the axes of the dowel holes 22, 24, 26. These holes are positioned to intercept and break into the walls of the dowel holes as shown in the drawings. The amount of interference into the dowel holes can vary. Threaded shanks 40 are now inserted into these four holes by threading into the holes. It will be seen in FIG. 3 that the threads of shanks 40 extend into the dowel holes 22, 24, 26 on each side. The dimensions are such that when a dowel is passed through the hole, there is 3/64" compression of the dowel on each side and contact with dowel of about three thread crests.

The holes 30, 32, 34, and 36 are preferably countersunk at 50 and filled with wooden plugs 52.

In the use of the device, plain dowels are cut to any desired length and the block 20 secured in a vice or by some other means. The dowels are driven through the block in the proper hole and this compresses the surface of the dowels on opposite sides into continuous creases or striations as shown at 60 on the dowel 62. If desired, the dowel may be turned 90° and driven through the holes again, thus providing striations on four sides of the dowel.

The crests of the threads compress the wood of the dowels and are not intended to remove any material. When a creased dowel is used, the glue surrounding it will flow into the grooves, and, in a blind hole, the dowel may be bottomed since excess glue will be forced out through the grooves and may be wiped off. The glue will cause the compressed wood to swell out essentially to its original shape and provide a tight joint.

What I claim is:

1. A tool for forming striations in a wooden dowel by lineal pressing the outer surface of the dowel which comprises a block having a transverse hole extending through the block to receive axially a dowel, a metal shank having spaced crested annular ridges such as a screw shank extending into said block on an axis perpendicular to the axis of said hole and on each side of said hole, the axes of said shanks being spaced relative to the axis of said hole so that the annular ridges extend into the sides of the said hole, whereby when a dowel is forced endwise into and through said hole, said ridges will press axial creases into the surface of said dowel.

2. A tool as defined in claim 1 in which said block has a plurality of transverse holes of varying size spaced from each other on parallel axes, and a plurality of metal shanks extending into said block, one shank being positioned between any adjacent holes and one shank being positioned at each end of said plurality of holes.

* * * * *